US006041830A

United States Patent [19]

Herzig et al.

[11] Patent Number: 6,041,830

[45] Date of Patent: Mar. 28, 2000

[54] DISPLACEABLE WARP BEAM SUPPORT BEARING FOR WARP BEAMS ARRANGED ONE ABOVE THE OTHER

[75] Inventors: Marcel Herzig; Heinz Baumann, both of Winterthur, Switzerland

[73] Assignee: Sulzer Rueti AG, Rueti, Switzerland

[21] Appl. No.: 09/170,962

[22] Filed: Oct. 13, 1998

[30] Foreign Application Priority Data

Dec. 9, 1997 [EP] European Pat. Off. ..... 97810956

[51] Int. Cl.[7] ..... D03J 1/00

[52] U.S. Cl. ..... 139/1 R; 242/533.2; 139/102

[58] Field of Search ..... 139/1 R, 102; 28/201, 208; 242/533.2

[56] References Cited

U.S. PATENT DOCUMENTS 3,707,995 1/1973 Pfarrwaller ..... 139/97
4,112,981 9/1978 Freisler ..... 139/25
5,259,420 11/1993 Foster ..... 139/97
5,653,267 8/1997 Graser ..... 139/1 R

FOREIGN PATENT DOCUMENTS

4326606A1 1/1995 Germany .

*Primary Examiner*—Andy Falik
*Attorney, Agent, or Firm*—Townsend and Townsend and Crew LLP

[57] ABSTRACT

The warp beam frame (21) for warp beams which are arranged one above the other has bearing arrangements (24, 25) which comprise end bearings and a support bearing (27) which is arranged between the latter for the reception of the warp beams and a device (33) for the pivoting of the support bearing of the upper bearing arrangement (24) in order to provide a passage for the heald frames during a change of article. The warp beam frame and the weaving machine enable a rapid change of article, in particular at broad weaving machines, and require little space.

10 Claims, 7 Drawing Sheets

DISPLACEABLE WARP BEAM SUPPORT BEARING FOR WARP BEAMS ARRANGED ONE ABOVE THE OTHER

The invention relates to a warp beam frame for warp beams which are arranged one above the other and have two end bearings for the reception of a warp beam and at least one support bearing between the end bearings.

The known broad weaving machines upwards of about 4 m web width are as a rule provided with at least two warp beams, which are arranged to lie one behind the other. Each of these warp beams can be assembled from two or more partial warp beams which are, for example, pushed onto an axle tube. Disadvantageous in warp beams which are arranged one behind the other in the travel direction of the warp proves to be the considerable space requirement connected therewith.

Furthermore, in broad weaving machines of this kind a heald frame guide and/or a heald frame drive is arranged above the heald frames. In particular the heald frame drive which is arranged in the superstructure proves disturbing for a change of article, since the heald frames cannot be lifted out or inserted respectively as a unit with the drawn-in warp, so that the heald frames must be replaced individually and the warp threads must be drawn in directly at the weaving machine.

For a change of article in broad weaving machines, extremely long standstill times, which extend over several weeks depending on the web width, result therefrom.

SUMMARY OF THE INVENTION

It is therefore an object of the invention to provide a warp beam frame for warp beams which are arranged one above the other and enable a rapid changeover of the machine for producing different articles.

The advantages to be achieved with the invention are that the space requirement is considerably reduced and that a change of article can be carried out simply and rapidly.

A broad weaving machine with a warp beam frame in accordance with the present invention is characterized by connecting the warp beam frame directly to the machine frame of the weaving machine or to a frame which accommodates the weaving machine.

BRIEF DESCRIPTION OF THE DRAWINGS

The invention will be explained in the following with reference to the accompanying drawings.

DESCRIPTION OF THE PREFERRED EMBODIMENTS

Reference is made to FIGS. 1 to 4, which show a first embodiment of a warp beam frame.

Figure 1:
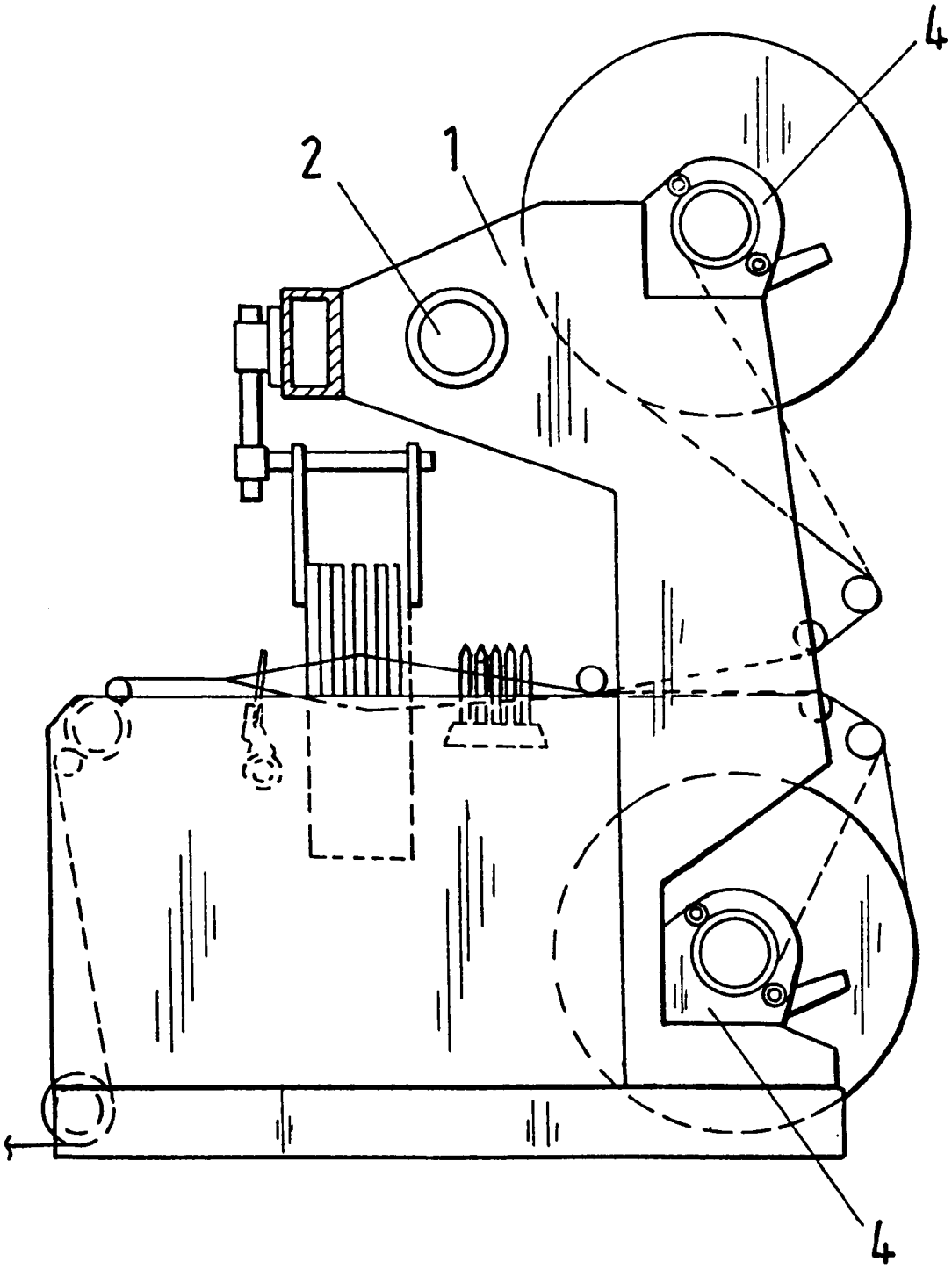
FIG. 1 is a side simplified view of a first embodiment of a warp beam frame in accordance with the invention.
Figure 2:
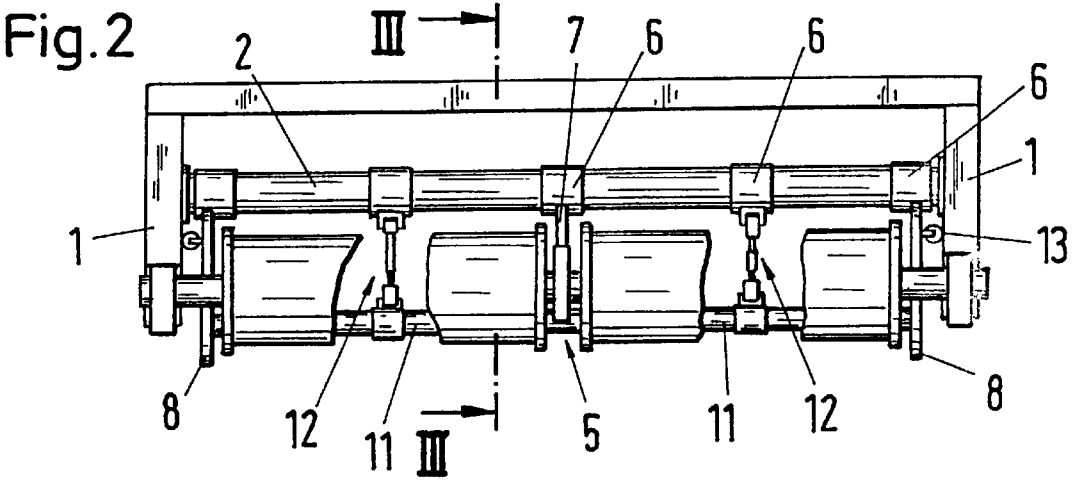
FIG. 2 is a plan view of the warp beam frame of FIG. 1.
Figure 5:
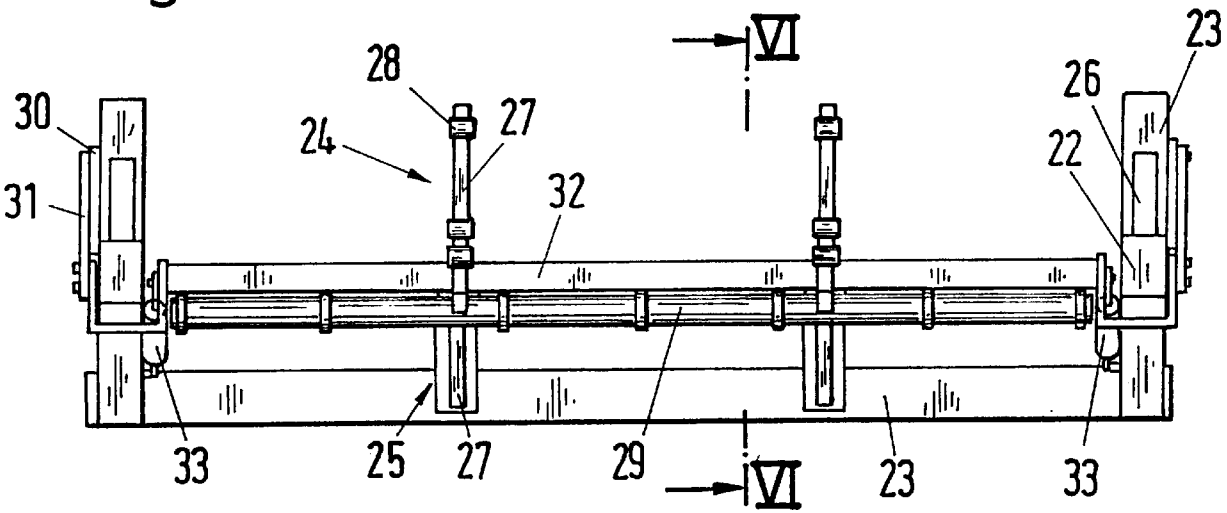
FIG. 5 is a plan view of a second embodiment of a warp beam frame made in accordance with the invention.
Figure 3:
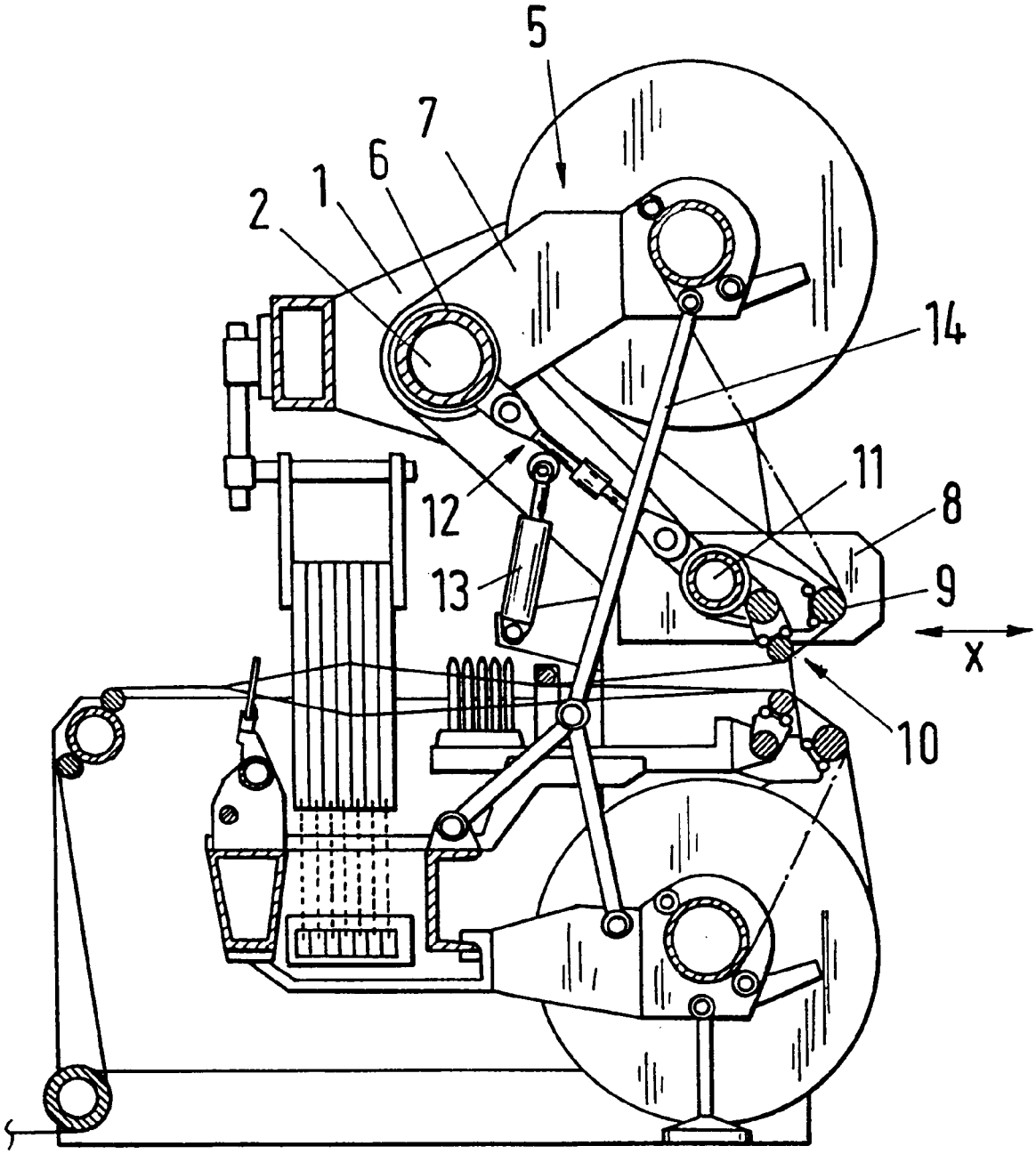
FIG. 3 is a sectional view taken along line III—III in FIG. 2.
Figure 4:
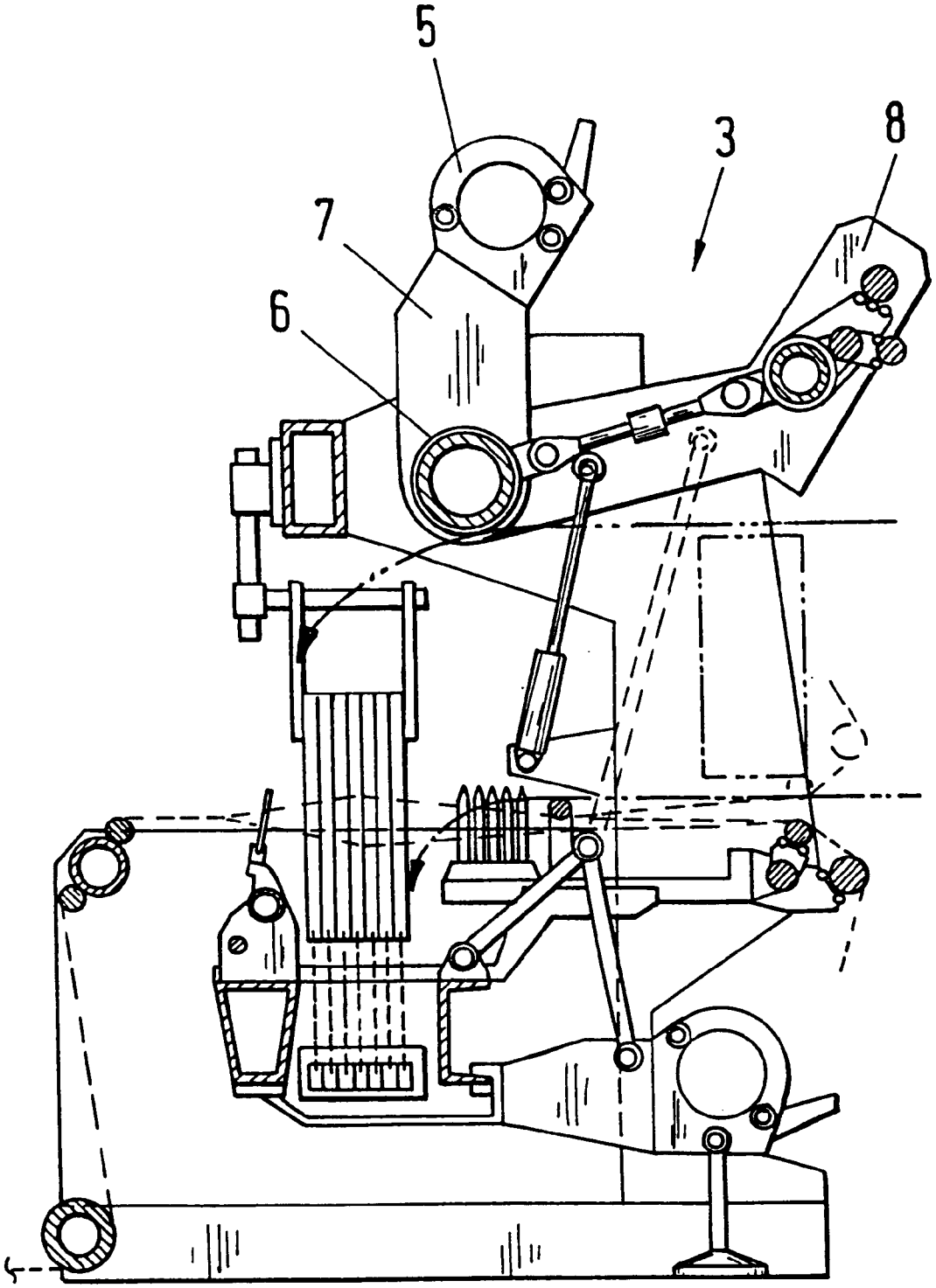
FIG. 4 is a view of the warp beam frame of FIG. 3 in a position for carrying out a change of article.

The warp beam frame is formed as a part of a broad weaving machine upwards of approximately 4 m web width and as such is connected by means of non-illustrated connection elements to the weaving machine. The weaving machine is designed for a lower and an upper warp beam with two partial warp beams in each case. The lower warp beams are journalled in an intermediate bearing which is a part of the weaving machine and in end bearings 4 at the warp beam frame, whereas the upper warp beams are journalled entirely at the warp beam frame. The warp beam frame contains two side parts 1 which are mounted at the side walls of the weaving machine, a carrier tube 2 which is rotatably journalled in the side parts, and a bearing arrangement 3 for the upper warp beam. The bearing arrangement 3 comprises two end bearings 4 which are mounted at the side parts 1 and a support bearing 5 which is arranged at the carrier tube 2 in such a manner that the support bearing is directed towards the middle of the weaving machine (FIG. 2). The bearing arrangement 3 has a hub 6 which is arranged on the carrier tube and a carrier 7 for the support bearing 5 which is connected to the hub 6. The bearing arrangement further comprises two carriers 8 which in each case are mounted by means of a hub 6 at the carrier tube 2 and a carrier tube 11 which is arranged on the carrier 8 so as to be displaceable in the x direction. A deflection beam 9 and an apparatus 10 for the tensioning of a warp are mounted at this carrier tube 11. Two arrangements 12 are provided for the setting of the deflection beam and of the tensioning apparatus 10 which are in each case pivotally connected at the one end to a hub 6 and at the other end to the carrier tube 11. In order to pivot or, displace the bearing arrangement 3 out of the operating position (FIG. 2) into the position for carrying out the change of article (FIG. 3) two lifting cylinders 13 are provided which are pivotally connected to the side parts and to the carrier 8. Furthermore, a support arrangement 14 is provided in order to support the bearing arrangement 3, in particular the support bearing 5, in the operating position. There remains only to be added that in the operating position the carriers 8 are supported and secured at both ends at the side parts 1.

Figure 7:
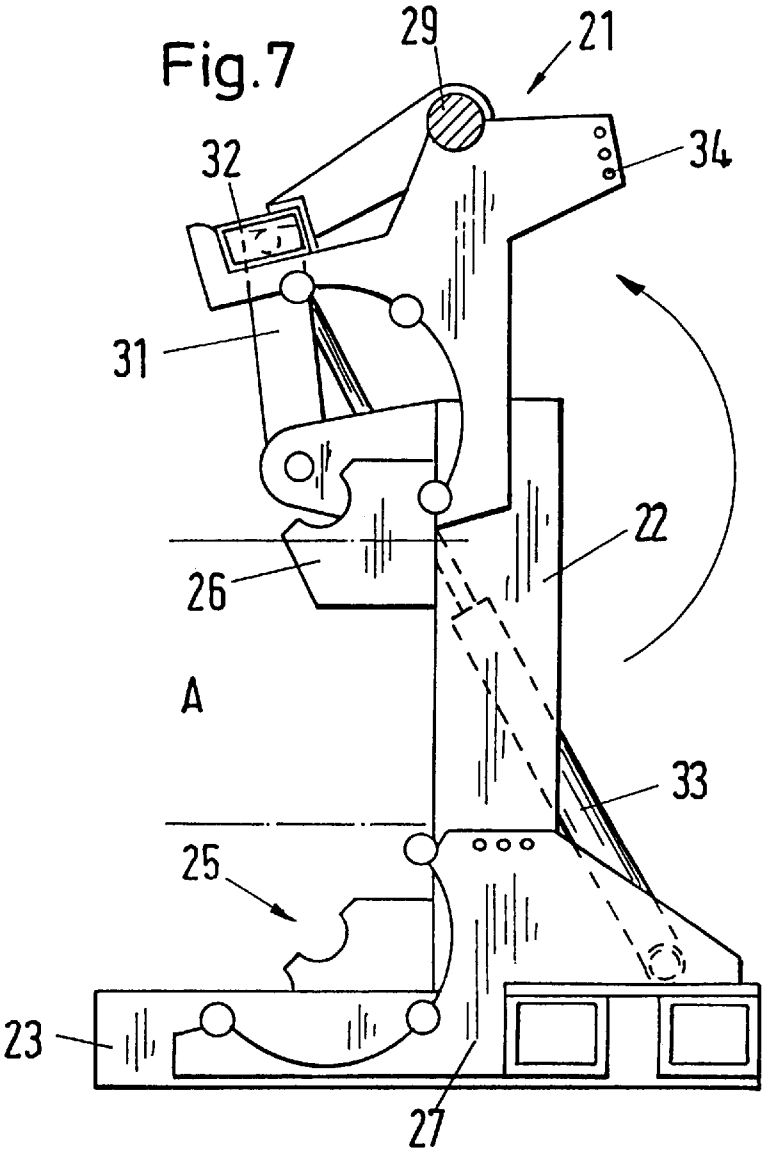
FIG. 7 is a view of the warp beam frame of FIG. 6 in a position for carrying out a change of article.
Figure 6:
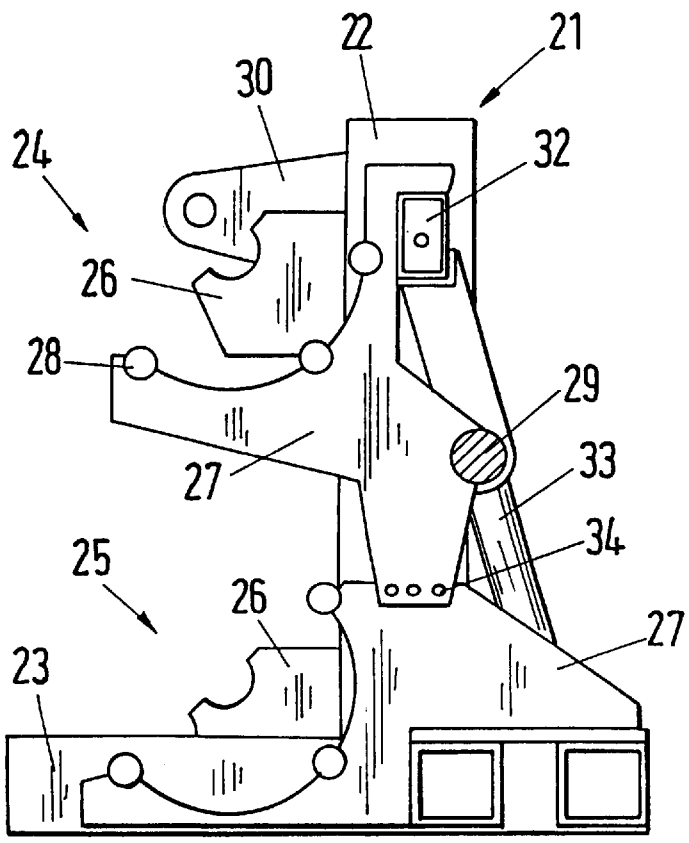
FIG. 6 is a sectional view taken along line VI—VI in FIG. 5.

Reference is made to FIGS. 6 and 7. The warp beam frame 21 has two columns 22 with a stand 23 and an upper and lower bearing arrangement 24, 25 for the reception of warp beams. Each bearing arrangement comprises two end bearings 26 for the reception of the warp beam axle which are mounted in each case at the columns 22 and two support bearings 27 which are arranged between the end bearings 26. The support bearings 27 are provided with rollers 28 on which the warp beams can roll during the weaving process. Support discs are arranged at the warp beam for this. A deflection beam 29 is journalled at the support bearings 27 of the upper bearing arrangement 25. The support bearings 27 of the lower bearing arrangement 25 are mounted at the longitudinal carriers which are associated with the warp beam frame. A bearing shield 30 at which a link 31 is pivotally connected is mounted at each of the columns 22. A carrier 32 which is connected to the support bearing 27 of the upper bearing arrangement is mounted at the links. Bearing arms (see FIGS. 6 and 7) for the deflection beam 29 are mounted at the carrier 32 in the end region. Furthermore, two lifting cylinders 33 are pivotally connected at one end in each case to the ends of the carrier 32 and at the stand 23 at the other end. In the operating position the support bearings 27 of the upper bearing arrangement 24 are supported on the support bearings 27 of the lower bearing arrangement 25 and secured through suitable means 34.

After the mentioned securing has been released the support bearings 27 of the upper bearing arrangement 24 are pivoted upwards through an actuation of the lifting cylinders 33 so that a free space A is provided between the columns 22 and the support bearings 27 of the upper and the lower bearing arrangement 24, 25 in order to carry out a change of article.

Figure 8:
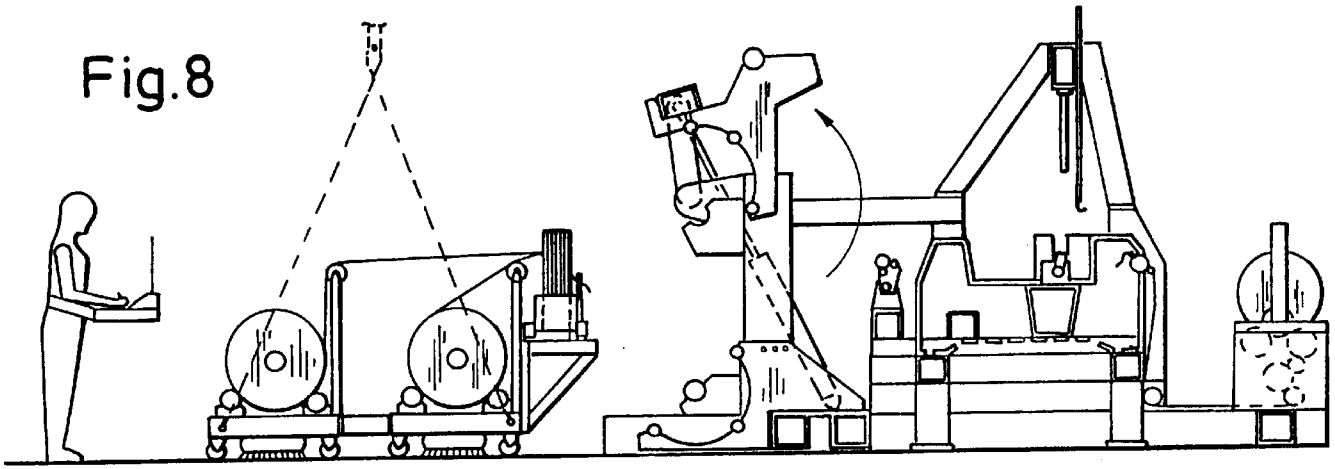
FIGS. 8 to 11 are schematic illustrations of a change of article in a broad weaving machine with a warp beam frame.

Reference is made to FIG. 8, which shows the essential steps during a change of article in the above-described weaving machine. A change of article is mostly prepared in separate rooms in accordance with a known work method. The components which are provided with the article to be changed, i.e. warp beams, heald frames, the reed and where required the warp thread monitor apparatus, are brought to the weaving machine, with the above-named components e.g. being formed into a transport unit. The transport unit is preferably driven over the floor via generally known transport means and/or overhead by means of a ceiling crane. The weaving machine itself is prepared for the change of article; i.e. the upper support bearing and the deflection device are pivoted upwards and the guide device for the heald frames is taken off or pivoted from the holder respectively.

Figure 9:
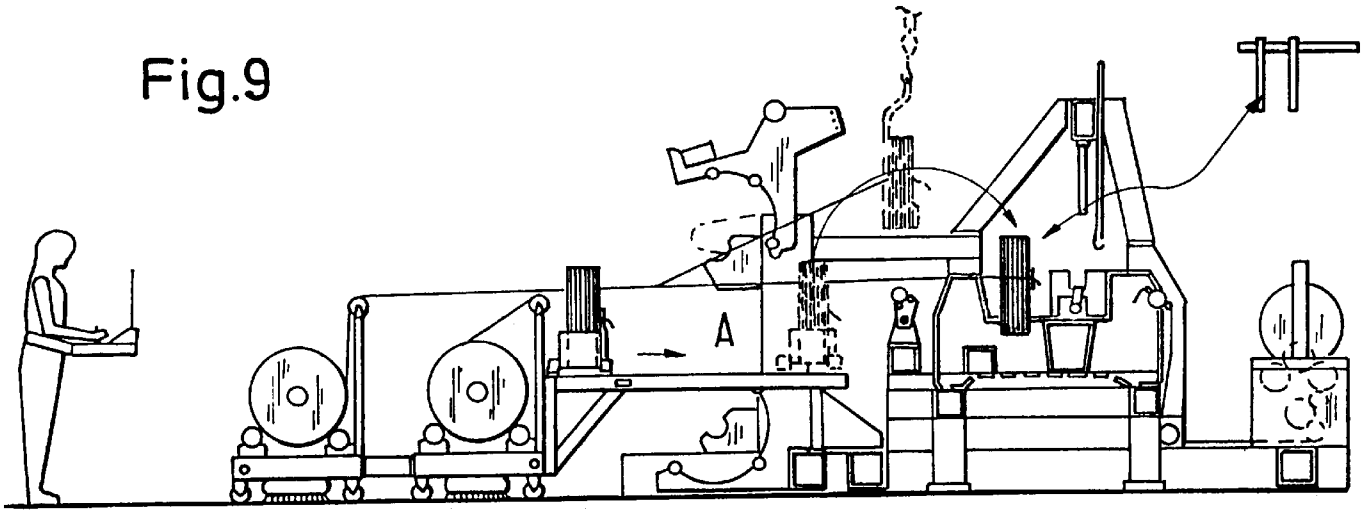

The insertion of the heald frame packet and of the guide device is illustrated in FIG. 9. The advantage of the above-described weaving machine in a change of article can be seen from this illustration.

Figure 10:
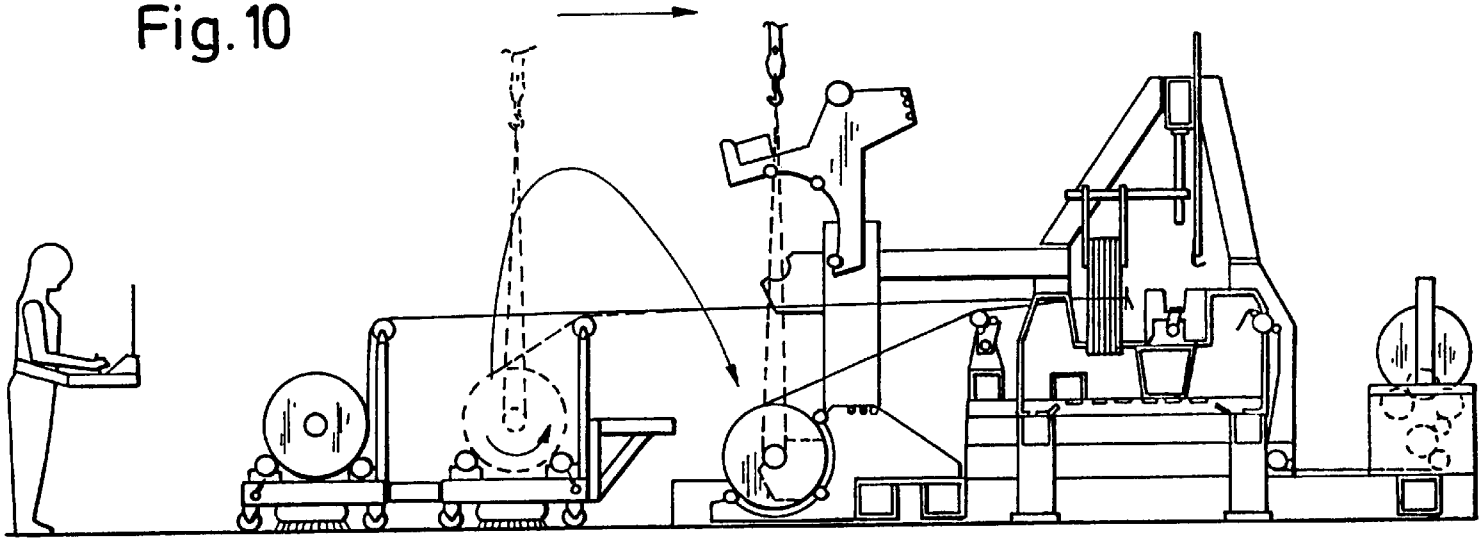

As shown in FIG. 10 the lower warp beam is then laid in. The warp threads are tensioned so that the latter lie on the device for the tensioning of the warp.

Figure 11:
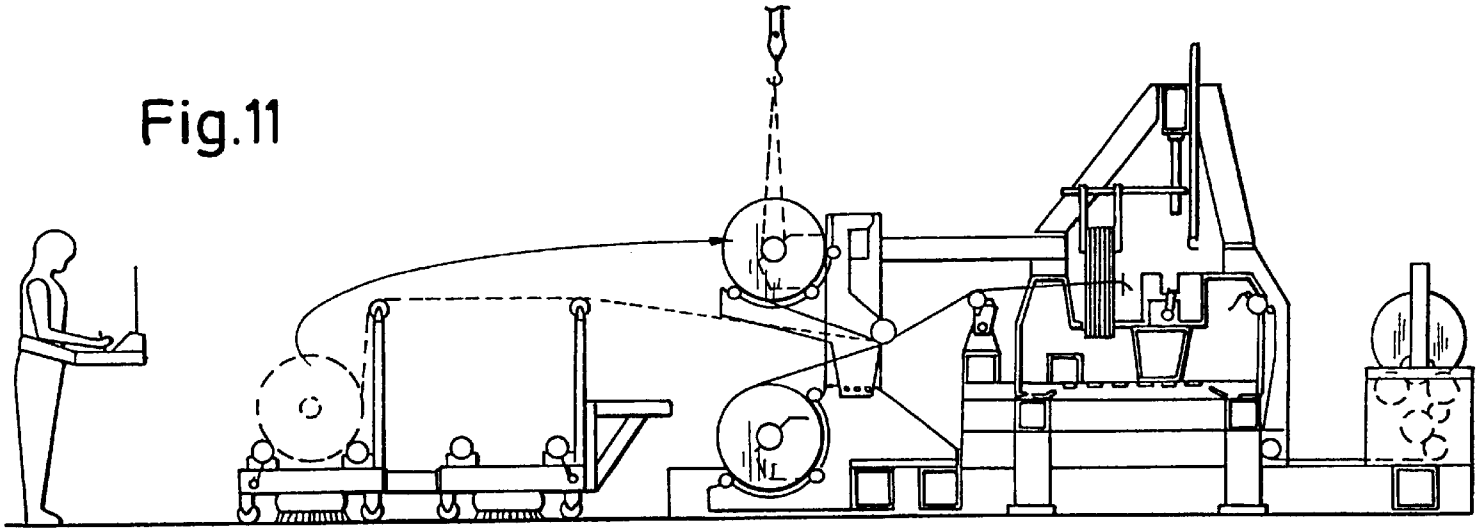

As shown in FIG. 11 the support bearings of the upper bearing arrangement are pivoted into the operating position in a next step and arrested at the support bearings of the lower bearing arrangement. The deflection beam is placed in the operating position through this pivoting. Then the upper warp beam is laid into the end bearings and the support bearings of the upper bearing arrangement.

The further non-illustrated procedure comprises the insertion of the reed and the connection of the warp to the cloth residue or the connection of the warp to the cloth beam respectively. After the setting of the depressor the change of article is completed.

The warp beam frame 21 for warp beams which are arranged one above the other has bearing arrangements 24, 25 which comprise end bearings and a support bearing 27 which is arranged between the latter for the reception of the warp beams and a device 33 for the pivoting of the support bearing of the upper bearing arrangement 24 in order to provide a passage for the heald frames during a change of article.

What is claimed is:

1. A frame for warp beams arranged one above the other comprising an upper bearing arrangement for receiving a warp beam including first and second end bearings and at least one support bearing located between the end bearings, the support bearing being displaceably connected to the frame, and a device for displacing the support bearing relative to the frame to thereby create a free space for carrying out a change of article.

2. A frame in accordance with claim 1 including a lower bearing arrangement with first and second lower end bearings and a lower support bearing which are arranged at fixed locations.

3. A frame in accordance with claim 1 including a deflection beam arranged at the support bearing of the upper bearing arrangement for actively contacting a weaving warp.

4. A frame in accordance with claim 1 including a carrier mounting the support bearing and first and second bearing shields, and links pivotally connecting the carrier and the hearing shields.

5. A frame in accordance with claim 1 including side parts and a carrier tube rotatably journalled in the side parts, the end bearings of the upper bearing arrangement being arranged at the side parts and each support bearing being arranged at the carrier tube.

6. A frame in accordance with claim 1 including a first carrier tube and first and second carriers arranged at the first carrier tube, and a second carrier tube adjustably arranged at the first and second carriers.

7. A frame in accordance with claim 6 including a deflection beam and an apparatus for tensioning a weaving warp arranged at the second carrier tube, and at least one setting arrangement pivotally connected at one end to a hub and at the other end to the second carrier tube for setting, the deflection beam and the apparatus for tensioning to thereby set the tension of the weaving warp.

8. A frame in accordance with claim 1 including at least one arrangement for supporting the support bearing of the bearing arrangement.

9. A frame according to claim 1 wherein the support bearing is pivotally connected to the frame and the device pivotally displaces the support bearing.

10. A weaving machine comprising a machine frame for the weaving machine, and a warp beam frame for warp beams arranged one above the other and including an upper bearing arrangement for receiving a warp beam including first and second end bearings and at least one support bearing located between the end bearings, the support bearings being displaceably connected to the frame, and a device for displacing the support bearing relative to the warp beam frame to thereby create a free space for carrying out a change of article.

* * * * *